United States Patent [19]

Cartier

[11] 4,402,198

[45] Sep. 6, 1983

[54] WATER PUMPING AGITATOR FOR AUTOMATIC WASHERS

[75] Inventor: Roger J. Cartier, St. Joseph Township, Berrien County, Mich.

[73] Assignee: Whirlpool Corporation, Benton Harbor, Mich.

[21] Appl. No.: 294,299

[22] Filed: Aug. 19, 1981

[51] Int. Cl.[3] ..... D06F 13/02

[52] U.S. Cl. ..... 68/18 FA; 68/53; 68/134

[58] Field of Search ..... 68/18 FA, 53, 132, 133, 68/184, 134

[56] References Cited

U.S. PATENT DOCUMENTS 2,642,733 6/1953 McCormick et al. ..... 68/18 FA X

*Primary Examiner*—Philip R. Coe
*Assistant Examiner*—Frankie L. Stinson
*Attorney, Agent, or Firm*—Hill, Van Santen, Steadman & Simpson

[57] ABSTRACT

A fluid pumping agitator for use in a vertical axis automatic clothes washing machine which pumps wash liquid from an inlet in the skirt portion of the agitator to an outlet in the barrel portion of the agitator. The agitator pumps liquid in both directions of its oscillatory rotational movement. The barrel portion has a chamber in which can be placed wash liquid treatment means such as a filter.

12 Claims, 7 Drawing Figures

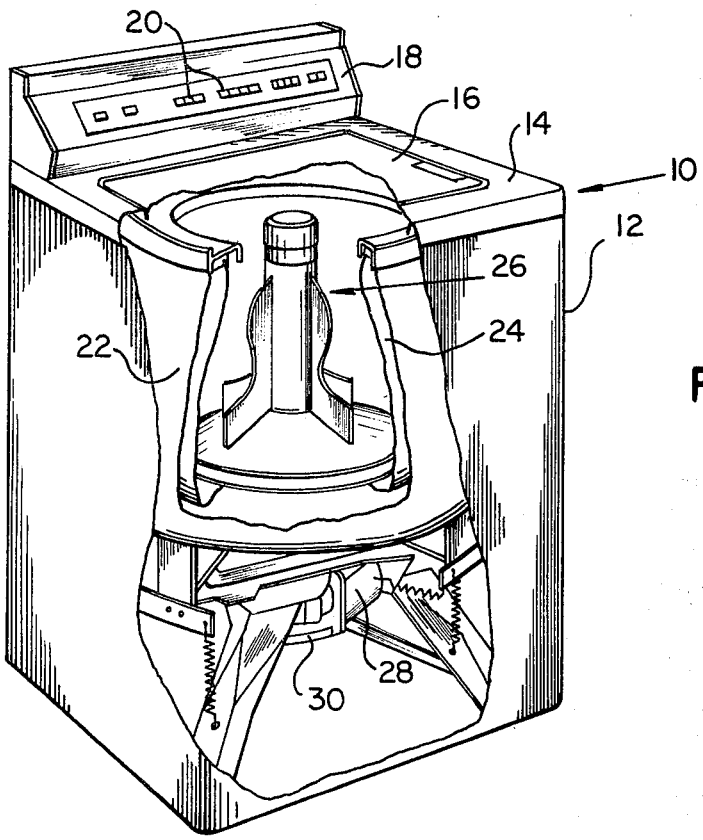
FIG. 1
FIG. 3
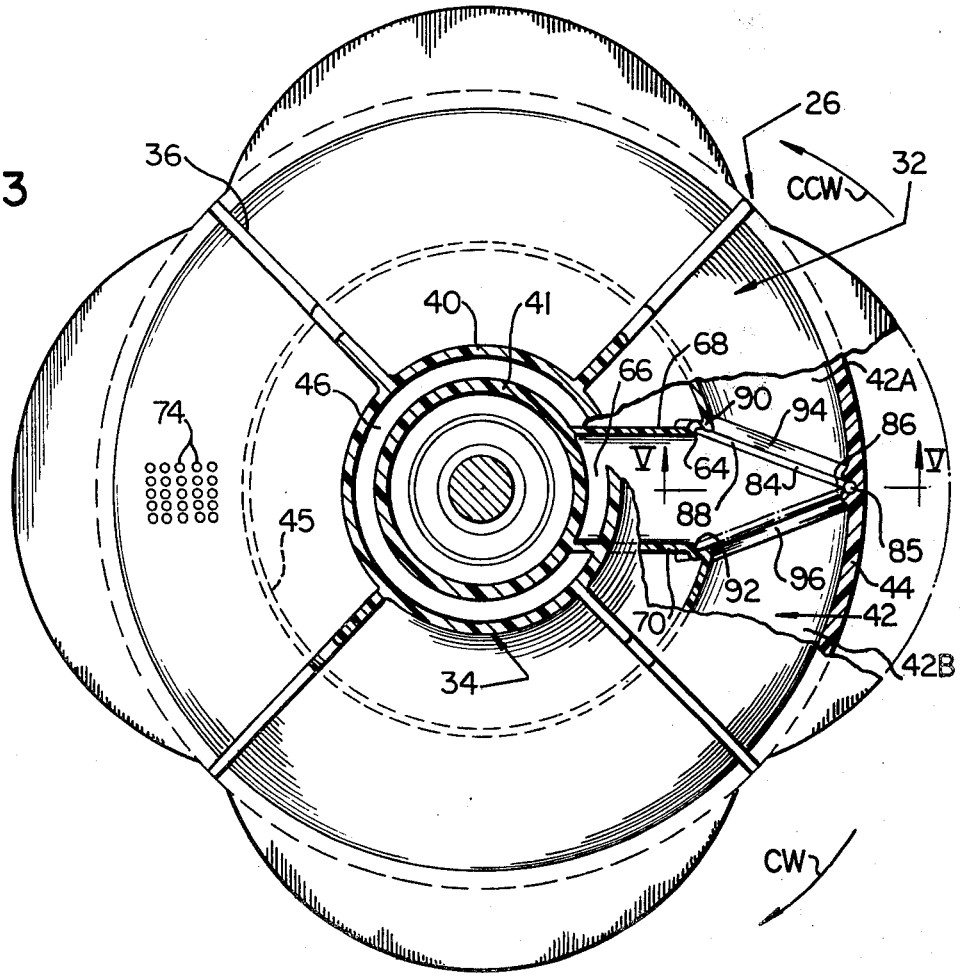

WATER PUMPING AGITATOR FOR AUTOMATIC WASHERS

BACKGROUND OF THE INVENTION

1. Field of the Invention

This invention relates to a washing machine having a liquid pumping agitator, and more particularly to a washing machine wherein wash liquid is pumped upwardly through the interior of the agitator during the wash cycle.

2. Description of the Prior Art

Various attempts have been made at pumping wash liquid upwardly through the agitator of an automatic washing machine during the washing cycle. U.S. Pat. No. 2,909,051 discloses a wash liquid pumping agitator in which the agitator travels through an orbital path as opposed to rotating about a center axis and within the interior of the agitator there is provided a positive displacement pump which has an expanding and contracting chamber integrally connected with a cam arrangement to force the wash liquid upwardly through the agitator. Check valves are provided to maintain the flow of wash liquid up through the agitator in one direction.

U.S. Pat. No. 3,022,655 discloses a valveless pumping agitator which utilizes four spiral portions to ram wash liquid through inlet openings 26 upwardly through the spiral passage to the barrel of the agitator when the agitator moves in a clockwise portion of an oscillatory movement.

U.S. Pat. No. 3,091,954 discloses a positive displacement piston pump utilizing a fixed check valve and a floating check valve to pump wash liquid upwardly through the agitator as the agitator moves up and down in a reciprocating motion.

U.S. Pat. No. 3,145,553 discloses a vaned positive displacement pump which utilizes two sets of check valves to provide the wash liquid flow upwardly through the agitator to an agitator mounted filter.

SUMMARY OF THE INVENTION

In accordance with the present invention a wash liquid pumping agitator for an automatic washer is provided wherein the inertia of the wash liquid in the washer basket relative to the oscillatory movement of the agitator is used to force the wash liquid to follow a path through a channel in the skirt of the agitator and up the barrel to discharge from the top of the agitator. The channel in the agitator comprises an annulus around the skirt of the agitator having an inlet in the top wall of the agitator skirt and an outlet on the opposite side of the annulus from the inlet opening to a vertical channel extending up the interior of the agitator barrel.

The annulus thus provides two channel passages from the inlet to the outlet around opposite circumferential sides of the agitator skirt. A flapper valve means is provided in the annular channel adjacent the outlet to alternately close off the opposite side portions of the channel to the outlet. The purpose of the flapper valve is to close off the channel portion in which the wash liquid would tend to move from the outlet toward the inlet due to the rotation of the agitator, thus tending to retard that motion and carry the wash liquid with the agitator as it moves.

Thus, as the agitator rotates in a first direction, the flapper valve moves to a first position to close off the first channel portion. Movement of the wash liquid in the first channel portion is retarded. In the first position, the flapper valve opens the second channel portion for flow of wash liquid from the inlet through the second channel portion to be ramped up the vertical channel in the barrel. The inertia of the wash liquid relative to the reversed movement of the agitator forces the wash liquid to follow the path from the outlet of the annular channel up the channel in the barrel.

As the agitator rotates in the second opposite direction the flapper valve moves to a second position to close off the second channel portion retarding movement of wash liquid in the second channel portion and opening the first channel portion for flow of wash liquid from the inlet through the first channel portion to be ramped up the vertical channel in the barrel. In this way the flapper valve provides a means for pumping of the wash liquid in both directions of movement of the agitator as it rotationally oscillates.

The wash liquid which has been forced up the vertical channel in the barrel can be used for various functions such as filtering and/or dispensing of wash additives.

BRIEF DESCRIPTION OF THE DRAWINGS

FIG. 1 is a perspective view of a washing machine embodying the present invention, partially cut away to show the interior mechanism thereof.

FIG. 3 is a sectional view of the agitator taken generally along the lines III—III of FIG. 2.

DESCRIPTION OF THE PREFERRED EMBODIMENTS

Figure 2:
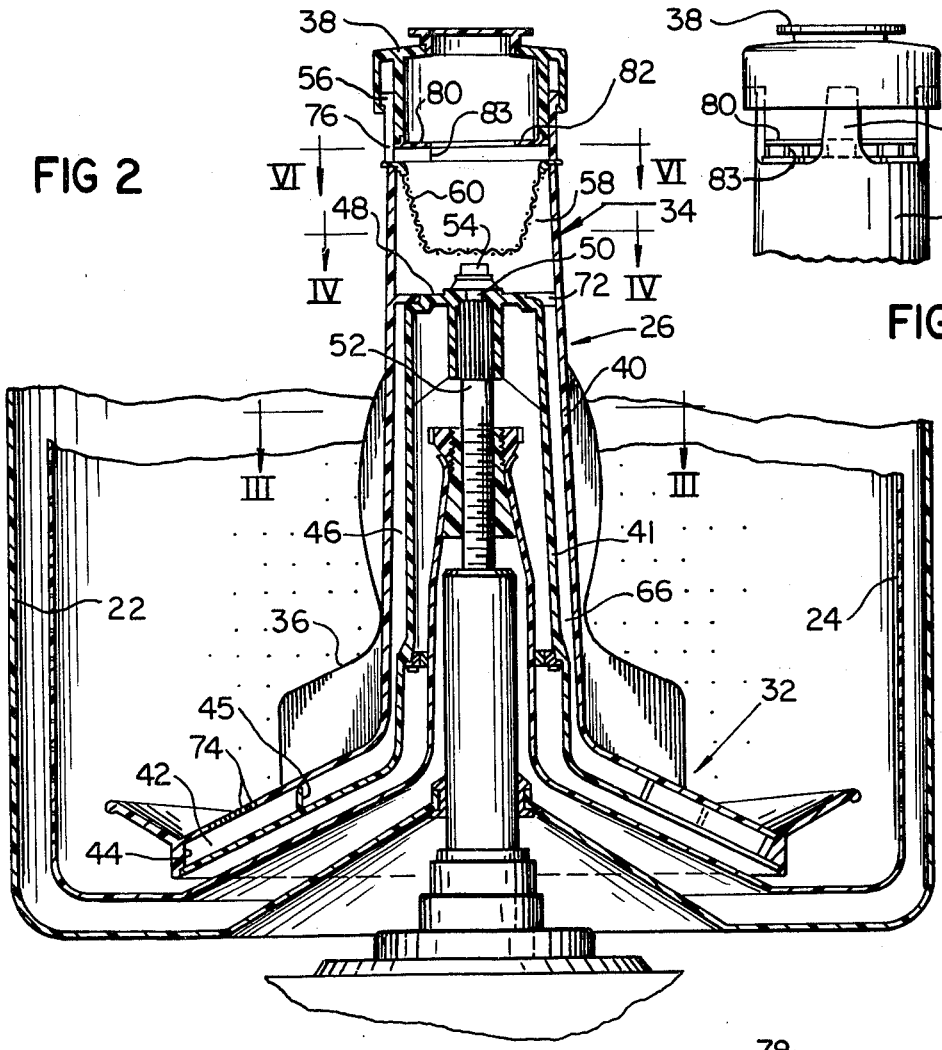
FIG. 2 is a side sectional view of the agitator assembly within the tub and basket of the washing machine of FIG. 1.

A laundry appliance 10 comprising an automatic clothes washer embodying the principles of the present invention is depicted in FIG. 1. The washer is comprised of a cabinet 12 having a top 14 with a lid 16 and a console 18 having presettable controls 20 thereon of the type wherein an operator may pre-select a program of automatic washing, rinsing and drying steps in a laundering process. The lid 16 in the top 14 of the cabinet 12 permits access into a tub 22 housed within the cabinet 12. Enclosed and supported within the tub 22 is a clothes container or spin basket 24 within which is oscillatably mounted an agitator 26.

Below the tub 22, but within the cabinet 12, there is provided an electric motor 28 which oscillatably drives the agitator 26 through a transmission 30. The agitator 26 is shown in greater detail in FIGS. 2 and 3 where it is seen that the agitator 26 is comprised of a skirt portion 32 near the bottom of the agitator and a substantially vertical barrel portion 34 integrally connected with the skirt and projecting upwardly therefrom. A plurality of vanes 36 are provided around the periphery of the barrel 34 and extend downwardly and outwardly along the skirt portion 32 of the agitator 26. At the top of the barrel 34 there is provided a removable cap 38 which is frictionally retained thereon.

The agitator 26 is of a two-wall construction having an outer wall 40 and a radially inwardly spaced inner wall 41. In the skirt portion 32 of the agitator there is thus provided an annular space or channel 42 which extends around the entire circumference of the skirt portion. A first substantially vertical circumferential wall 44 and a second substantially vertical circumferential wall 45 spaced radially inwardly of the first wall 44 define the side walls of the annular channel 42.

The barrel portion 34 likewise has an annular space or channel 46 provided between the inner wall 41 and the outer wall 40. The annular channel 42 and the annular space 46 are separated by the second circumferential wall 45.

The top of the inner wall 41 terminates below the top of the outer wall 40 in a top wall 48 which has a central opening 50 therethrough for receipt of a portion of a drive shaft 52 which rotates the agitator 26 in an oscillatory motion. The agitator 26 is secured by means of appropriate fastening means 54 such as a bolt threaded into the end of the shaft 52. The outer wall 40 continues upwardly beyond the top wall 48 of the inner wall 41 and terminates at a top end 56 to which the cap 38 is secured.

In this manner, a chamber 58 is provided between the top wall 48 of the inner wall 41 and the cap 38 at the top of the agitator 26. Within this chamber 58 can be provided a filtering means 60 which may be removably secured within the chamber 58.

Figure 4:
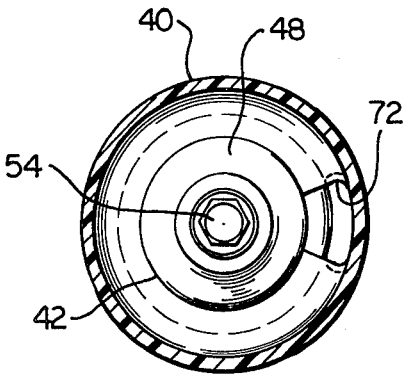
FIG. 4 is a sectional view of the barrel of the agitator taken generally along the lines IV—IV of FIG. 2.

As best seen in FIG. 3, there is an outlet opening 64 in the wall 45 which provides access from the annular channel 42 to a vertical channel 66 formed within the annular space 46 and defined between two vertical walls 68, 70. The vertical channel 66 has an inlet channel **66*a* in skirt 32 extending from the opening 64 in the skirt barrier wall 45. The channel 66 extends from inlet 66*a* through the space between the inner wall 41 and outer wall 40 of the agitator barrel 34 to exit through an opening 72 which leads into the cavity 58 near the top of the barrel portion 34 as shown in FIG. 4**.

Figure 7:
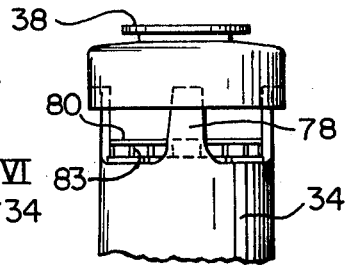
FIG. 7 is a partial side elevational view of the top of the agitator barrel.
Figure 6:
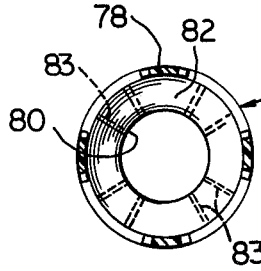
FIG. 6 is a sectional view of the barrel of the agitator taken generally along the lines VI—VI of FIG. 2.

A plurality of inlet apertures 74 are provided in the outer wall 40 in the skirt portion 32 opposite the outlet opening 64. A plurality of outlet apertures 76 are provided at the top of the agitator barrel 34 between fingers 78, as best seen in FIGS. 6 and 7 which are also used to retain the cap 38 in position. A spacer 80 having a top annular wall 82 and a plurality of downwardly depending radial wall portions 83, as best seen in FIGS. 6 and 7 is provided to direct the flow of wash liquid radially outwardly through the outlet openings 76 and to secure the filter means in position when the cap 38 is installed. To exit from the chamber 58 the wash liquid must pass through the filter means 60. Thus, there is provided a fluid path from the interior of the basket 24 through the inlet openings 74 in the skirt portion and through annular channel 42, through the outlet opening 64, through the inlet channel **66*a* and into the vertical channel 66, up into the cavity 58 and through the outlet openings 76**.

Figure 5:
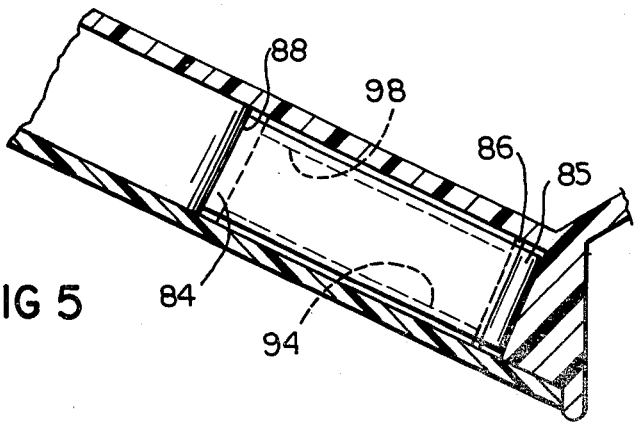
FIG. 5 is a partial sectional view of the flapper valve taken generally along the lines V—V of FIG. 3.

As seen in FIG. 3, the liquid has two flow paths between inlet openings 74 and the outlet opening 64 between the annular channel 42 and the vertical channel 66. As viewed in FIG. 3 these two paths are the top portion of channel 42 being designated **42*a* and a bottom half of channel 42 being designated 42*b*. A flapper valve means 84 is retained by means of a pivot pin 85 provided in a first end 86 of valve means 84 and secured to the exterior circumferential wall 44 of the skirt 32. This flapper means 84, which is also shown in FIG. 5, extends across the width of the annular channel 42 and effectively separates portion 42*a* from portion 42*b*. A second end 88 of the flapper means 84 can be sealingly seated in a recess 90 provided at the junction of vertical wall 68 and wall 45 at one side of the opening 64 or in a second recess 92 provided at the junction of the vertical wall 70 and wall 45 at the other side of the opening 64**.

Ramped stop members 94 and 96 are provided along the bottom edge of the flapper means 84 and similar stops such as 98 are provided along the top edge of the flapper means 84 to provide for a continuous seal around the edges of the flapper means 82.

Periodically throughout the steps of the washing operation, the agitator is rotated in an oscillatory manner such that part of its rotation is in a clockwise direction as shown by arrow CW and another part of its rotation is in a counterclockwise direction as shown by arrow CCW. During this movement, there is a supply of wash liquid within the basket 24 which is generally above the level of the skirt portion 32 of the agitator 26 such that the wash liquid enters the inlet openings 74 and completely fills the entire annular channel 42. As agitator 26 oscillates, the flapper means 84 causes the agitator to act as a pump in the following manner.

As the agitator rotates in the clockwise direction as shown by arrow CW, the inertia of the wash liquid within the channel 42 tends to result in a relative rotational movement between the liquid and the agitator 26. In this manner the liquid in the channel portion designated **42*b* pushes against the flapper means 84 as the flapper means 84 is rotated away from the liquid in the channel portion 42*a*. This causes the second end 88 of the flapper means 84 to seat in the recess 90 and against stops 94 and 98 thereby to effectively seal off communication between the opening 64 and the channel portion 42*a* to retard movement of the liquid in portion 42*a* and to ramp the current flow of the stream from channel portion 42*b* up vertical channel 66. As the agitator continues to rotate in a clockwise direction the liquid is forced through opeming 64, through inlet channel 66*a*, up through vertical channel 66, through opening 72 into the chamber 58, through filter means 60 and out through outlet openings 76**.

As the agitator 26 reverses its motion and begins rotating in a counterclockwise direction, as shown by arrow CCW, the liquid in channel portion **42*a* pushes against flapper means 84 while the flapper means 84 is rotated away from the liquid in channel portion 42*b*, thus causing the flapper means 84 to rotate about pivot 84 until the second end 88 is seated in the recess 92 and the flapper means 84 abuts against stop 96 effectively sealing off communication with channel portion 42*b*. As the agitator continues its counter-clockwise rotation, the wash liquid is again forced through opening 64, into channel 66*a*, up vertical channel 66, through opening 72 into chamber 58, through filter means 60 and out through outlet opening 76**.

Thus, it is seen that the agitator 26 acts as a pump while oscillating in both the clockwise and counterclockwise direction without need of a check valve to prevent the reverse flow of wash liquid in channel 66. The flapper means automatically responds to the changes in oscillatory direction to control and directionalize the liquid flow in the agitator.

It is of course possible to substitute various other valve means for the flapper valve 84 shown in the drawings. If lint from the clothes circulating in the wash bath tends to disable the flapper, a ball valve means may provide a valve means more suitable for use under these conditions.

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

The embodiments of the invention in which an exclusive property or privilege is claimed are defined as follows:

1. In a vertical axis automatic washer having a basket for containing clothes to be washed in the washing liquid, a drive means for providing an oscillatory motion to a vertical agitator shaft extending within said basket, a liquid pumping agitator mounted for oscillatory movement with said shaft, said liquid pumping agitator comprising:

a vertical barrel drivenly connected to said shaft, said barrel defining an interior passage extending upwardly from a lower end of said barrel to an outlet in said barrel fluidly connected to said basket;

a skirt integrally connected to said lower end of said barrel, said skirt defining an interior passage formed as an annulus fluidly connected at an inlet to said basket and at an output to said barrel passage;

said skirt outlet spaced from said skirt inlet in said annulus to divide said annulus into two channel portions; and a valve means in said annulus at said skirt outlet for alternately closing an adjacent end of each of said channel portions as said agitator oscillates with said shaft, whereby washing liquid is pumped by the oscillatory motion of said agitator from said skirt inlet to said barrel outlet.

2. A washing machine agitator comprising:

a vertical barrel defining an outlet and an interior passage extending upwardly from a lower end of said barrel to said barrel outlet;

a skirt integrally connected to said lower end of said barrel, said skirt defining an outlet to said barrel passage, an interior passage formed as an annulus and an inlet through said skirt;

said outlet spaced substantially 180° from said inlet in said annulus to divide said annulus into two substantially equal channel portions; and a valve means in said annulus at said skirt outlet for alternately closing an adjacent end of each of said channel portions.

3. For use in an automatic washer, an agitator means comprising:

a vertical barrel adapted to be driven in an oscillatory manner, said barrel defining an outlet and an interior passage extending upwardly from a lower end of said barrel to said barrel outlet;

a skirt integrally connected to said lower end of said barrel, said skirt defining an outlet fluidly connected to said barrel passage, an interior passage formed as an annulus, and an inlet opening through said skirt, said skirt inlet and outlet fluidly connected to said annulus;

said skirt outlet spaced from said skirt inlet in said annulus to divide said annulus into two channel portions; and a valve means in said annulus at said skirt outlet for alternately diverting liquid in said annulus channel portions from said annulus through said skirt outlet, whereby the oscillatory motion of said agitator in said automatic washer operates to pump washing liquid from said skirt inlet to said barrel outlet.

4. The agitator means of claim 3, wherein said interior passage in said barrel contains a chamber portion in which can be removably mounted a washing liquid treatment member.

5. The agitator means of claim 3, wherein said annular passage inlet is comprised of openings through a top wall of said skirt.

6. The agitator means of claim 3, wherein said valve means is comprised of a flap which is pivotally mounted in said annulus.

7. The agitator means of claim 3, wherein said outlet in said barrel is positioned adjacent the top of the barrel.

8. The agitator means of claim 3, wherein said vertical barrel has a removable top cap portion which provides access to the interior of said barrel.

9. In an automatic washer of the type having an oscillatory agitator, the improvement of:

pumping means comprising channel means forming a circulatory path extending upwardly through said agitator and through which liquid is to be pumped; and valve means at a lower end of said channel means below the level of liquid during operation of the agitator and movably responsive to oscillation of the agitator;

said channel means defining a seating means engageable with said valve means upon movement of said agitator in at least one direction to form together with said valve means a means for pumping liquid generally upwardly through said circulatory path.

10. In an automatic washer as defined in claim 9, and further characterized by a filter means in the circulatory path through which the pumped fluid is directed.

11. In an automatic washer as defined in claim 9, wherein said sealing means comprises valve seats on opposite sides of said valve means engageable therewith upon movement of said agitator in opposite directions.

12. In an automatic washer as defined in claim 11, wherein said valve means comprises a flapper valve.

* * * * *

UNITED STATES PATENT AND TRADEMARK OFFICE

CERTIFICATE OF CORRECTION

PATENT NO. : 4,402,198

DATED : September 6, 1983

INVENTOR(S) : Roger J. Cartier

It is certified that error appears in the above-identified patent and that said Letters Patent is hereby corrected as shown below:

Column 5, claim 1, line 34, before "to said barrel" delete "output" and insert -- outlet --.

Signed and Sealed this

*Eighth* Day of *November 1983*

[SEAL]

*Attest:*

GERALD J. MOSSINGHOFF

*Attesting Officer*

*Commissioner of Patents and Trademarks*